US008967435B2

(12) United States Patent
Nyambi et al.

(10) Patent No.: US 8,967,435 B2
(45) Date of Patent: Mar. 3, 2015

(54) PUSH-BUTTON DISPENSER WITH COMPRESSED-GAS CAPSULE FOR BEVERAGE BOTTLES

(75) Inventors: Samuel O. Nyambi, Marietta, GA (US); Fritz Seelhofer, Lindau (CH)

(73) Assignee: The Coca-Cola Company, Atlanta, GA (US)

( * ) Notice: Subject to any disclaimer, the term of this patent is extended or adjusted under 35 U.S.C. 154(b) by 181 days.

(21) Appl. No.: 13/643,458

(22) PCT Filed: Apr. 26, 2011

(86) PCT No.: PCT/EP2011/056525
§ 371 (c)(1),
(2), (4) Date: Feb. 11, 2013

(87) PCT Pub. No.: WO2011/134929
PCT Pub. Date: Nov. 3, 2011

(65) Prior Publication Data

US 2013/0134190 A1 May 30, 2013

(30) Foreign Application Priority Data

Apr. 28, 2010 (CH) ..... 0626/10

(51) Int. Cl.
*B65D 83/00* (2006.01)
*B65D 83/20* (2006.01)
*B67D 1/04* (2006.01)

(52) U.S. Cl.
CPC ..... *B65D 83/20* (2013.01); *B67D 1/0418* (2013.01)
USPC ..... 222/399; 141/17

(58) Field of Classification Search
CPC .. B67D 1/0412; B67D 1/0418; B05B 9/0833; B65D 83/663
USPC ..... 222/399, 397, 396, 398; 141/14–17, 64
See application file for complete search history.

(56) References Cited

U.S. PATENT DOCUMENTS 2,842,293 A * 7/1958 Knapp et al. ..... 222/399
3,065,883 A * 11/1962 Nelson ..... 222/323
4,982,879 A * 1/1991 Corrado et al. ..... 222/400.7
2009/0283553 A1 11/2009 Hoss

FOREIGN PATENT DOCUMENTS

FR 2092690 * 1/1972 ..... 222/399

OTHER PUBLICATIONS

Search Report for corresponding international application, PCT/EP2011/056525, issued Nov. 16, 2011.

* cited by examiner

*Primary Examiner* — Lien Ngo
(74) *Attorney, Agent, or Firm* — King & Spaulding

(57) ABSTRACT

The push-button dispenser with compressed-gas capsule (7) for bottles (2) consists of a head which can be screwed onto the bottle (2) and have a lateral pouring channel (4), a push-button (15) on its upper side and downwardly projecting suction tube (11). The latter is intended to extend as far as the base of the bottle (2) which is to be fitted with the dispenser, and it opens out at the top into a valve device in the head. This valve device has a regulating means (39) which can be moved axially in relation to the bottle (2) and is biased in the closing direction by a spring (17), and can be opened by manual pressure being applied to the push-button (15) from above. This reduces pressure in the interior of the suction tube (11) to ambient pressure, as a result of which liquid is expelled from the bottle (2), by way of the internal pressure prevailing in the bottle (2), out of the lower mouth opening of the suction tube (11) via the pouring channel (4). As a special feature, the dispenser is configured as a single-piece housing (14) with inner housing (37), which contains all the other elements of the dispenser, or bears the same externally.

11 Claims, 7 Drawing Sheets

PUSH-BUTTON DISPENSER WITH COMPRESSED-GAS CAPSULE FOR BEVERAGE BOTTLES

RELATED APPLICATIONS

Figure 1:
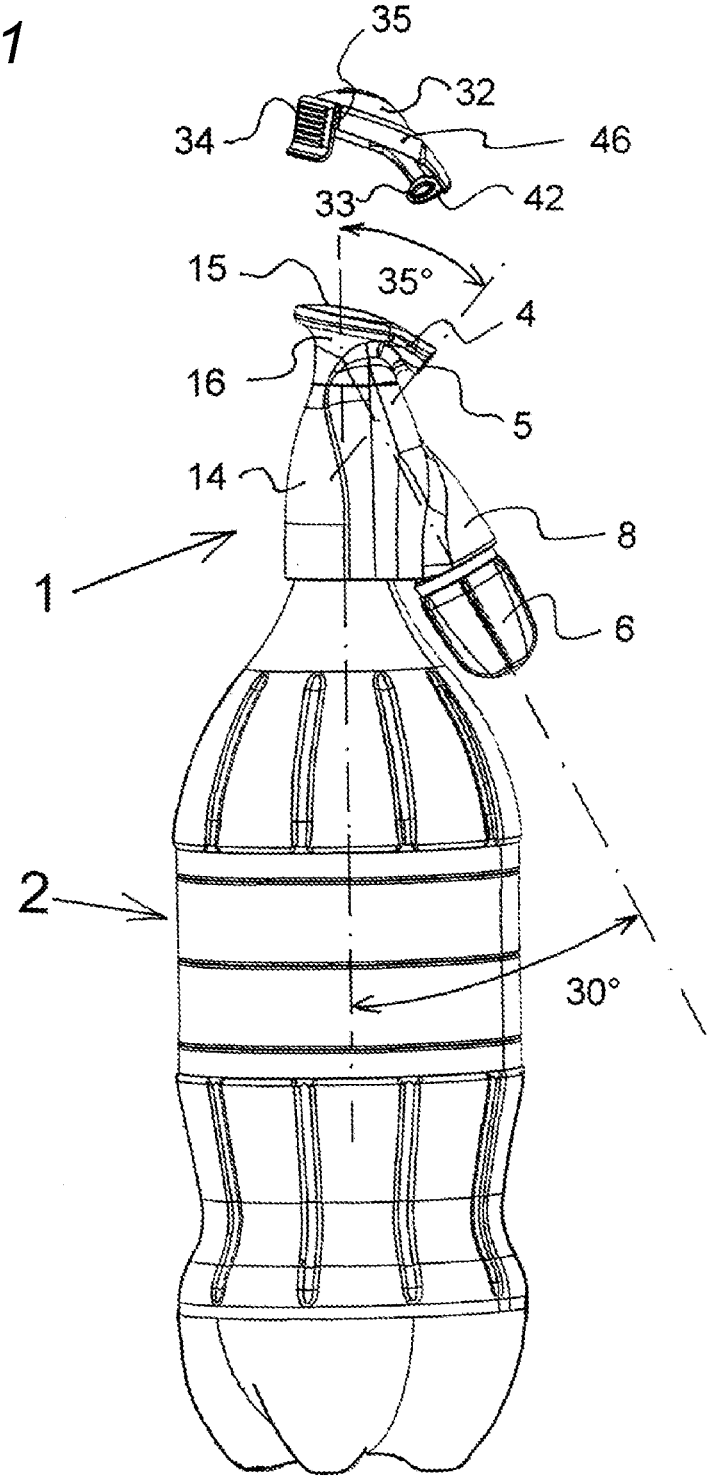

This application is a national phase application of international application number PCT/EP2011/056525, titled "Push-Button Dispenser With Compressed-Gas Capsule For Beverage Bottles," filed on Apr. 26, 2011, which claims priority to Swiss patent application number 00626/10 filed on Apr. 28, 2010. The present application claims priority to the foregoing applications and incorporates herein by reference in their entirety the content of the foregoing applications.

This invention concerns a dispenser to reliably dispense by means of a simple pushing of a button a carbonated or noncarbonated beverage from a bottle, such as a PET bottle, whether upright or horizontal. It is ensured that the pressure in the bottle never drops too low, so that a secure and complete emptying is guaranteed. Also, optionally, the beverage is kept fresh, since not only is the beverage placed under pressure with nitrogen, but also it is sufficiently carbonated with $CO_2$.

Carbonated and noncarbonated beverages are sold in glass and PET bottles, as well as aluminum cans, in very large numbers. Each day, many millions of such bottles chiefly in the form of PET bottles are opened and their contents poured out and drunk. When the beverage contains carbon dioxide, which gives freshness to the beverage, a rise in pressure in the bottle is produced by its outgassing. Everyone is familiar with the pffft sound that one hears when opening such a bottle. PET bottles come in various sizes, containing 0.33, 0.5, 1, 1.5, 2 or even 3 liters.

But the larger bottles are not easy to handle by all people. Especially small children or frail and elderly people report difficulty in the handling of heavy bottles. Often the bottles are kept in a refrigerator and when one desires a drink the bottle has to be taken out of the refrigerator, opened, lifted up for pouring, and tilted over a drinking glass, after which it is placed back in the refrigerator. These steps can be tiresome or even impossible to perform for small children or even weakened adults, as when they are sick, or old or disabled people. The first-time opening of the screw cap, which is also provided with a safety seal that needs to be broken to open, requires some expenditure of force, which cannot be mustered by everyone. Furthermore, the repeated opening and closing of such a beverage bottle leads to the escaping of some of the carbon dioxide, so that the beverage becomes stale and flat before it is entirely consumed.

To avoid these problems, various devices have been proposed that can be mounted on the mouth of the bottle in order to maintain the pressure in the bottle and dispense carbonated beverage from the bottle always in a fresh state whenever desired, without having to put up with an escaping of carbon dioxide. Belgian patent 743,485, for example, shows a device with a dispensing valve and a separate carbon dioxide valve to add carbon dioxide to the bottle when its internal pressure drops by a certain amount. According to Austrian patent 144,111, as well as U.S. Pat. No. 3,976,221, a pressure regulator is disclosed to regulate the carbon dioxide pressure in the beverage. But it is not only the pressure drop when dispensing carbonated bottle contents, which generally prevents a complete emptying, that is a problem. When a carbonated beverage is dispensed, it produces foam. This foaming is desirable to a certain extent and indicates that the beverage is fresh. But an excessive foaming is undesirable, because it prevents the glass from being filled in a reasonable time. Furthermore, the longer the bottle must remain open, the more carbon dioxide escapes, and the sooner the beverage will become stale and flat. Every swirling of the beverage during its dispensing and every nonlaminar flow contributes to the foam formation. Furthermore, the surrounding temperature plays a role. A cold carbonated beverage foams more as the surrounding temperature is warmer where the beverage is poured out after the pressure reduction. If, further, the bottle is shaken beforehand, this considerably sustains the outgassing and the problem of foaming becomes so severe that a proper dispensing of the bottle contents becomes nearly impossible.

Various approaches to a solution exist in the prior art, apparently solving the aforementioned problems. GB 2 219 988 shows a dispenser which can be screwed onto a bottle. An elastic tube runs down to the bottom of the bottle. A manually operated spring-loaded valve reduces the pressure in the outlet by opening of the compressed tube at a place very near to the discharge opening, in order to dispense the beverage from the bottle in a controlled way thanks to the increased internal pressure. The dispenser furthermore includes a pressure regulation with a $CO_2$ pressure capsule, from which $CO_2$ is added when the internal pressure of the bottle drops below a certain extent. However, this dispenser consists of a very large number of parts and is correspondingly expensive in manufacture and assembly.

Thus, although the basic principle of a dispenser with pressure capsule is known in various embodiments in order to dispense a beverage by controlled pressure drop in the discharge opening of the bottle thanks to the increased internal pressure in a carbonated or initially noncarbonated beverage, the fact remains that beverage bottles in practice are sold without such a dispenser and these systems for the most part have not taken hold. There might be a few dispensers on the market that can be screwed onto a bottle afterwards. But a first substantial portion of carbon dioxide or another pressurizing gas is already lost by the first-time opening of the bottle, in order to screw the dispenser onto the bottle. And on the other hand, such dispensers are in very little use—if at all.

It emerges from the opposition proceeding for European patent 1 737 759 that the following features constitute already known prior art: a device for discharging to the outside a fluid from a storage space of a container via at least one closable outlet opening, with a pressure reservoir separated from the storage space, in which a propellant is held under pressure, wherein the pressure reservoir can be connected to the storage space across a pressure regulating mechanism. The pressure regulating mechanism has an axially movable regulating element, which can be stressed by a biasing means so that it is held closed. The internal pressure acts on the regulating element in the closing direction. The ambient pressure acts on the regulating element in the direction of its open position. Furthermore, designs are known in which the pressure drop inside the bottle is compensated by subsequent automatic adding of $CO_2$ or another compressed gas from a capsule.

Thus, a new dispenser can not only involve the fundamental principle of the function, which is well known, but also only a specific embodiment of such a dispenser and a specific implementation of this fundamental principle, so that it is implemented technically better and more simply, and furthermore in such a way that makes such a dispenser a product that has a constantly reliable and secure functioning and an extremely easy operation. The safe precluding of any danger potential in connection with the pressure capsules is especially important, as they have pressures of around 60 bar. For example, if the pressure in a PET bottle were to rise to 12 bar, it might burst. If a carbonated cola beverage, for example, at an ambient temperature of 40° C., already produces an internal pressure in a bottle of up to 8 bar, it does not take much more pressure to bring it to the breaking limit. It must be possible to prevent this with absolute safety and reliability when working with an additional pressure source in the form of a compressed gas capsule. All these topics and conditions are basic requirements for such a dispenser having a chance to survive on the market.

The problem of the present invention is, in view of the aforesaid facts, to specify a push-button dispenser with compressed gas capsule for bottles with carbonated or noncarbonated beverages that eliminates the aforementioned problems and disadvantages and fulfills at least the following requirements:

- The dispenser should allow, by adding compressed gas from a pressure capsule as needed, for dispensing the bottle contents in any position of the bottle between upright and horizontal position without remnants—except for a few drops—into a drinking vessel, simply by activating a push-button.
- The dispenser should largely suppress the formation of foam during the dispensing by means of $CO_2$ gas and provide an appropriate rate of discharge.
- The dispenser should consist of a minimal number of parts and be easy to assemble, so that production becomes as economical as possible.
- The dispenser should be as compact as possible, so that it is no impediment to the logistics of the bottles outfitted with it and the bottle can be kept in a refrigerator both upright and horizontal.
- The dispenser should offer a first-opening guarantee, which also prevents any dirt from getting into the discharge opening before the dispenser is opened by the customer.
- The dispenser should ensure a reliable excess pressure protection so that when a maximum pressure limit is passed it initiates a relief process and self destructs to prevent further increases beyond the pressure limit.
- The dispenser should be reusable, for which only its compressed gas capsule needs to be replaced, which should be extremely easy for the user, completely danger-free, and absolutely safe to the functioning.
- The dispenser should make it possible to carry a bottle outfitted with it hanging conveniently between two curved fingers.

The main problem is solved by a push-button dispenser with compressed-gas capsule for bottles, with a head which can be screwed onto the bottle with a lateral discharge opening, a push-button on its upper side and downwardly projecting suction tube, which is designed to extend as far as the bottom of the bottle, and opens out at the top into a valve device in the head, which has a regulating means that can be moved axially in relation to the bottle and is biased in the closing direction by a spring, and can be opened by manual pressure being applied to the push-button, so that the pressure in the interior of the suction tube can be reduced to ambient pressure, as a result of which liquid is expelled from the bottle, by way of the internal pressure prevailing in the bottle, out of the lower mouth opening of the suction tube via the discharge opening, and characterized in that the dispenser has a single-piece housing, which contains all the other elements of the dispenser, or bears them externally, wherein the housing forms, at the side, an open accommodating cylinder with a steel piercing tube installed concentrically therein so as to be directed outwards, for the purpose of accommodating a pressure capsule, which can be pushed into this accommodating cylinder from underneath by its lead-sealed piercing closure until it reaches the tip of the piercing tube and is retained in this position by static friction, and this pressure capsule can be pushed further axially in the accommodating cylinder by screwing on an associated threaded cap with grip wings, so that the piercing tube, which is cut obliquely in front, pierces with sealing action its piercing closure.

The other problems are solved by a push-button dispenser with the above features when it furthermore has other specific features, depending on the problem, as emerge from the dependent claims.

By means of the figures, such a push-button dispenser with compressed-gas capsule is shown in an advantageous embodiment and its individual parts as well as the function of the push-button dispenser are described and explained afterwards.

There are shown:

FIG. 1: The push-button dispenser with compressed-gas capsule screwed onto a beverage bottle outfitted with it.

Figure 2:
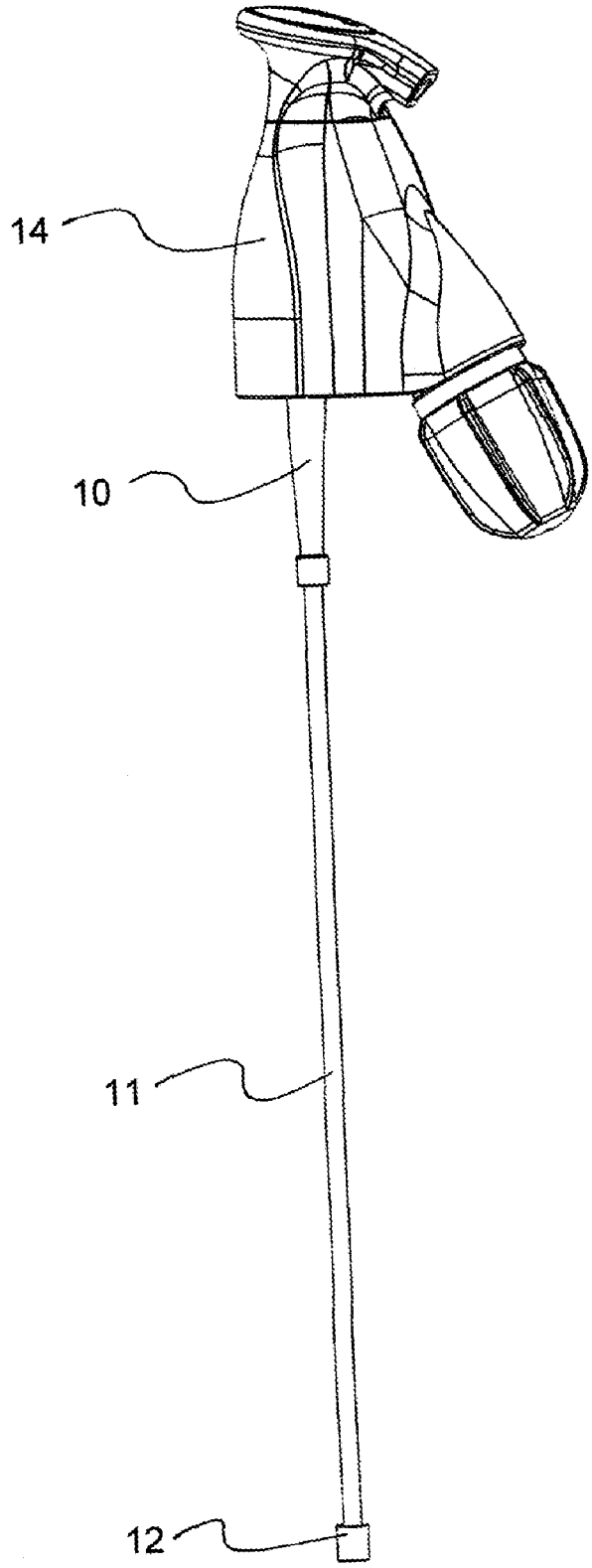
Figure 3:
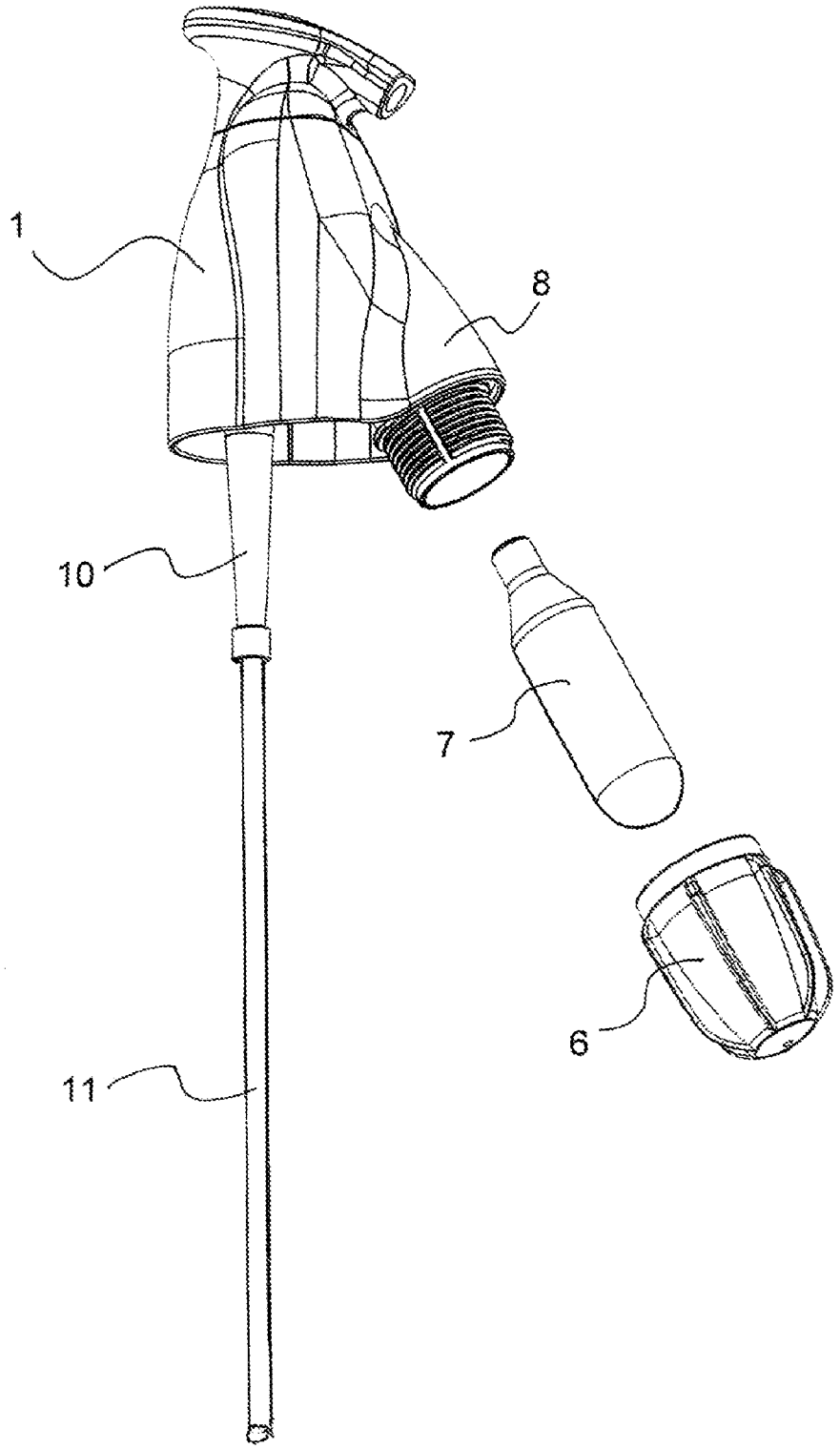
Figure 4:
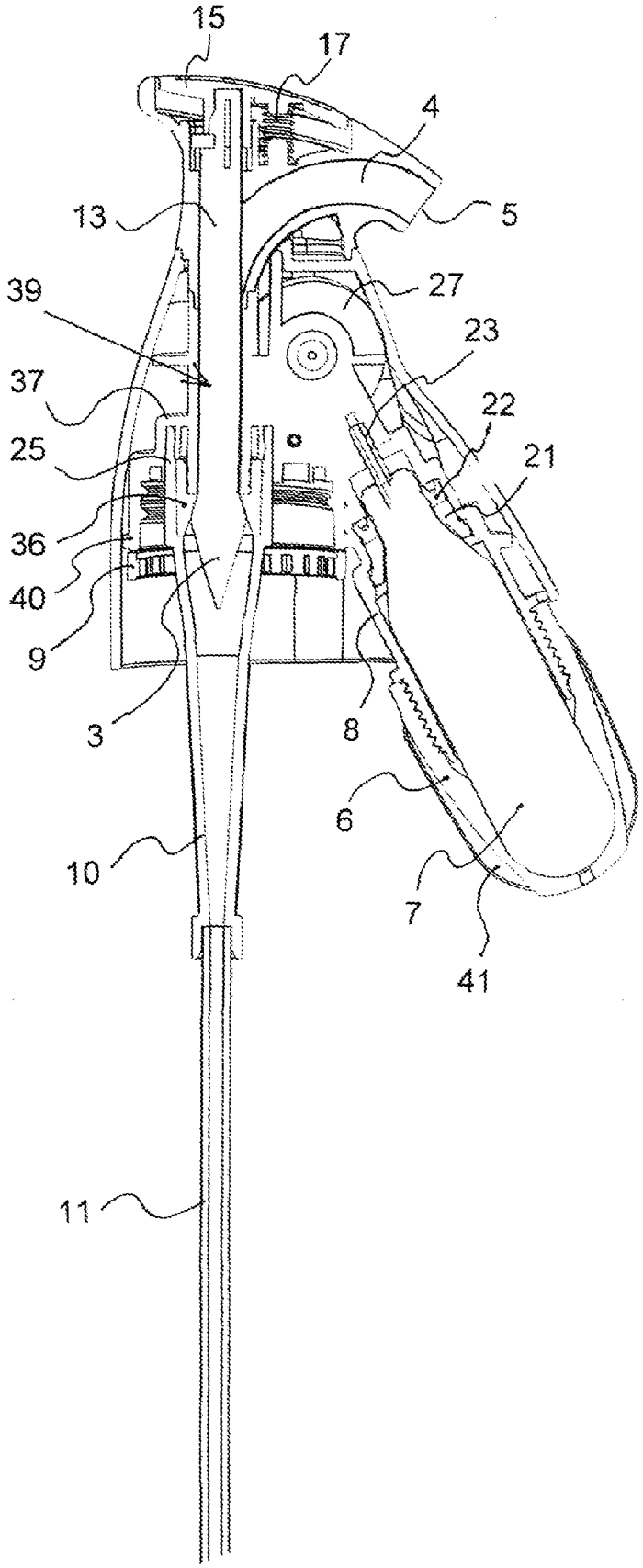
Figure 5:
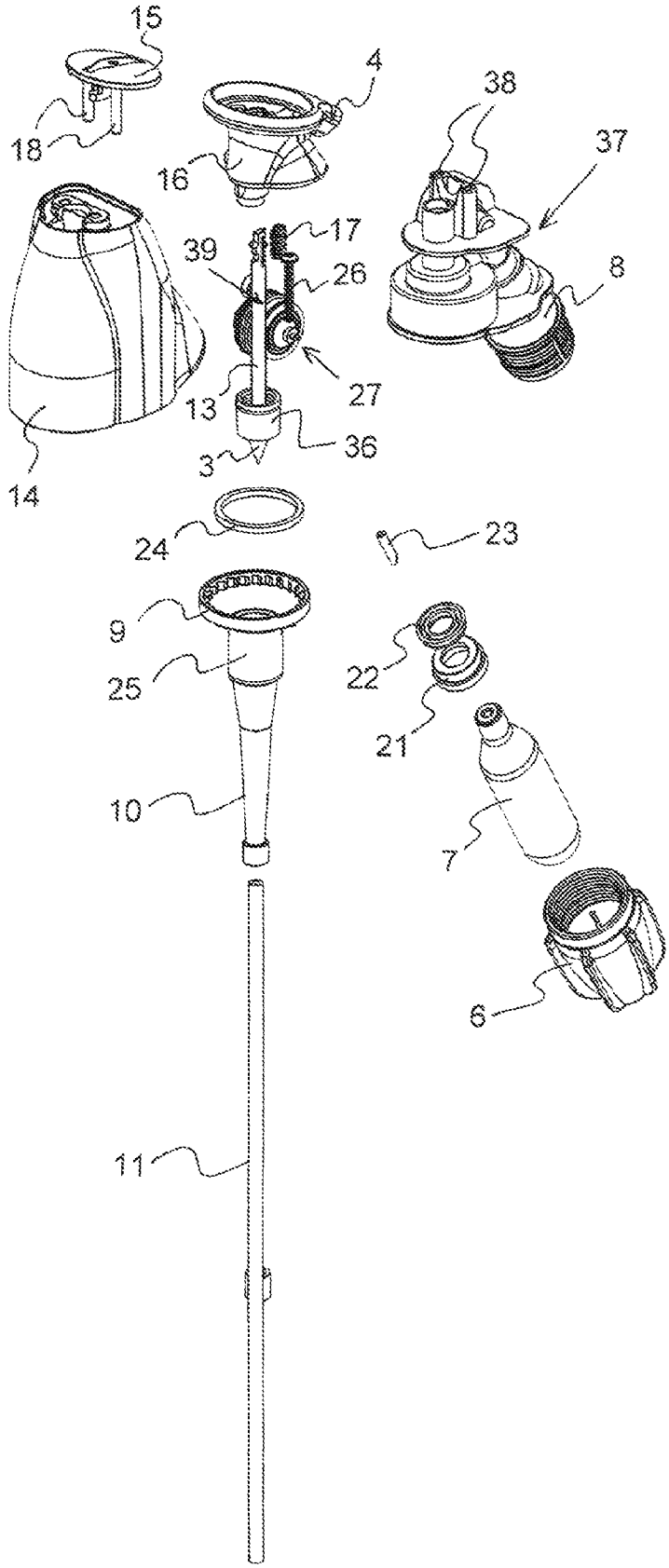
Figure 6:
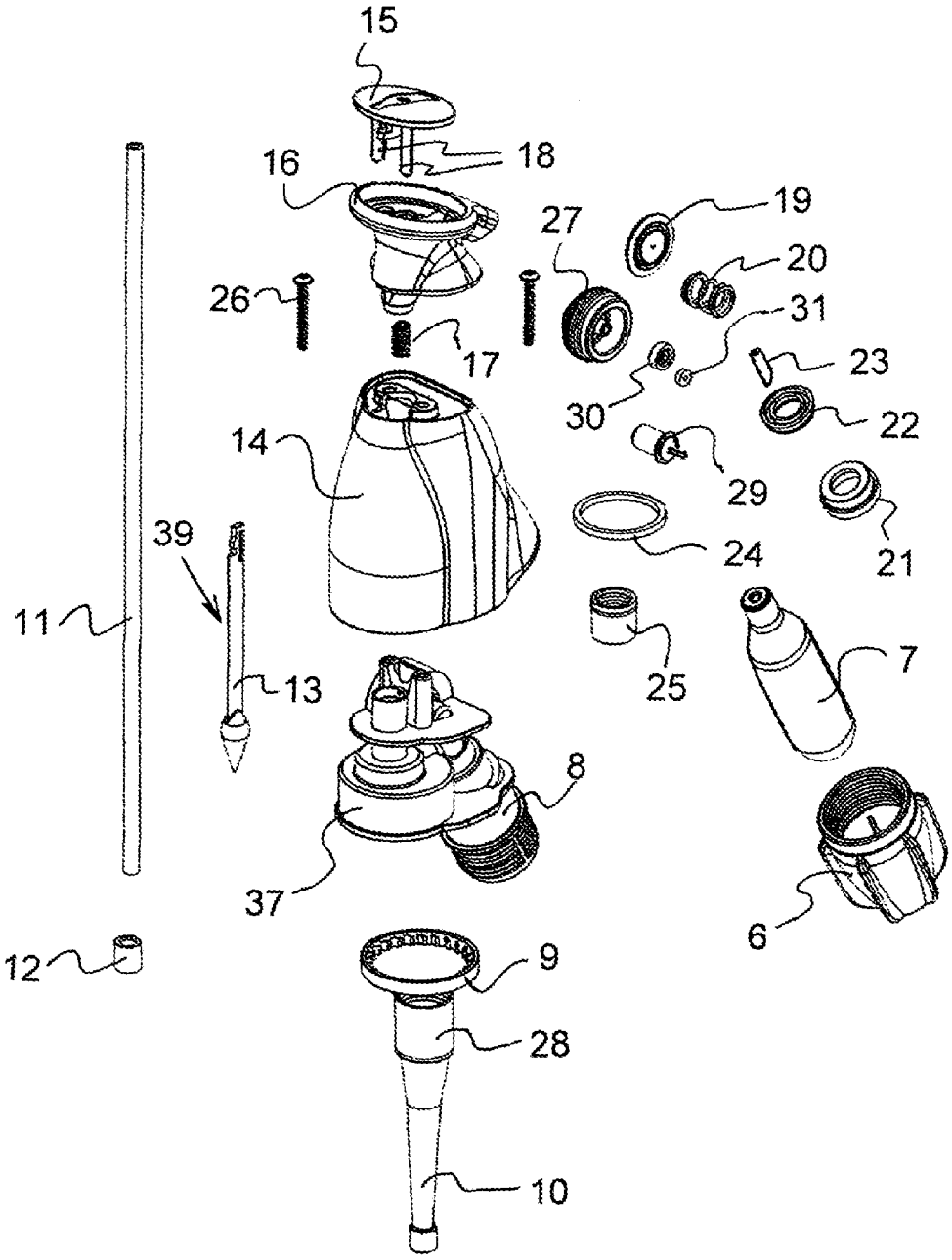
Figure 7:
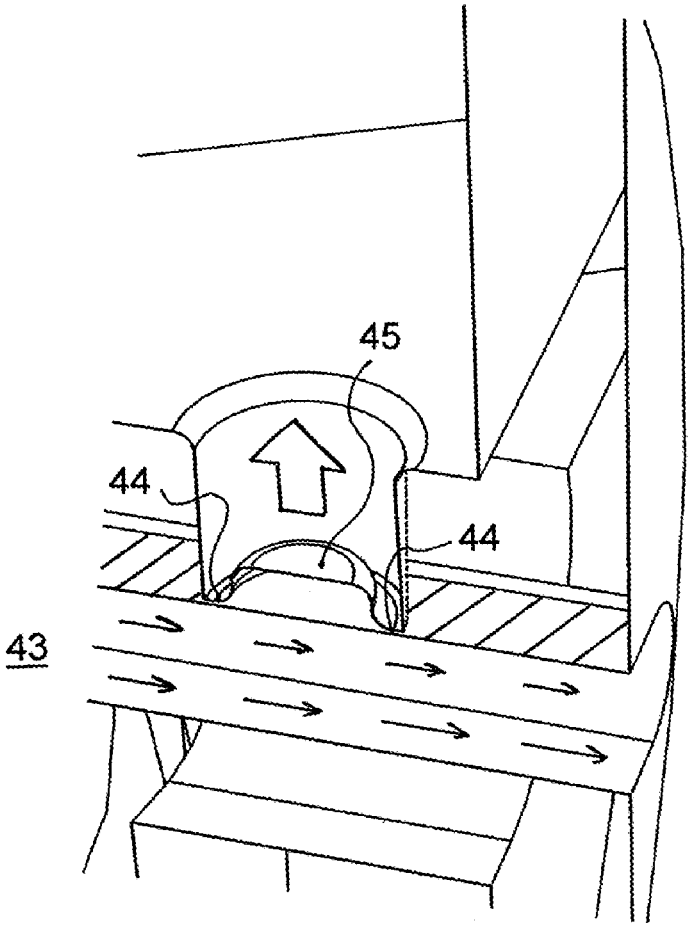

FIG. 2: The push-button dispenser with compressed-gas capsule and suction tube, without the beverage bottle;

FIG. 3: The push-button dispenser with compressed-gas capsule and suction tube, wherein the pressure capsule and the threaded cap are shown separate from their accommodating cylinder;

FIG. 4: The push-button dispenser with installed compressed-gas capsule in the assembled state in a sectional view along the axis of the suction tube and the accommodating cylinder for the compressed-gas capsule;

FIG. 5: The push-button dispenser with all its individual parts;

FIG. 6: The push-button dispenser in another representation with all its individual parts;

FIG. 7: An excess pressure safety mechanism on the valve housing in enlarged scale.

FIG. 1 shows the complete push-button dispenser 1 in the assembled state, screwed onto a beverage bottle 2. As a special attribute, this dispenser has a very compact construction and the lateral accommodating cylinder 8 for the compressed-gas capsule is arranged close against the dispenser housing, that is, it projects as shown outward and swiveled downward at an angle of only 30' from the thread axis of the dispenser, which corresponds to the bottle axis. At the top, as another special attribute, the push-button 15 is arranged at an oblique angle to the thread axis, that is, inclined on one side. Even so, the push-button 15 can be pressed down in the axial direction, i.e., in the direction of the thread axis. At its deepest position, the top of the push-button 15 is flush with the top boundary of the discharge channel 4, which runs downward at a slant, slightly curved downward, so that the plane perpendicular to its mouth 5 subtends an angle of around 35' with the thread axis of the dispenser, as shown. In this drawing of the dispenser one can only see four different parts from the outside, namely, at the top the push-button 15, the top piece 16 with the discharge channel 4, the housing 14 on which the top piece 16 sits, and finally the threaded cap 6 for the accommodating cylinder 8 of the compressed-gas capsule. The discharge channel 4 emerges on the same side of the dispenser where the compressed-gas capsule is also accommodated in it. As can be seen, thanks to the compact construction of the dispenser and the close fitting of the accommodating cylinder 8 for the pressure capsule, the dispenser will hardly project to the side beyond the bottle. The arrangement of the discharge channel 4 with slight downward curvature enables the dispensing of the beverage into a glass placed beneath it regardless of whether the bottle is standing upright or lying on its side.

Above the top piece 16 with discharge channel 4 there is shown a guarantee lid 32. This has on top a domelike cover, beneath which the actual push-button 15 of the dispenser comes to lie when the guarantee lid 32 is put in place. Toward the front the guarantee lid 32 merges into an angled cover 42, with a sealing ring 33 on its inner side, which fits into the mouth opening 5 of the discharge channel 4 and closes it. At the opposite side of the guarantee lid 32 one notices a guarantee tab 34, which is held at the side by at least one material bridge 35 with predetermined breaking point on the encircling band 46 of the guarantee lid 32. In the course of production, this guarantee lid 32 is snapped onto the top piece 16 and, after the parts cool down, this guarantee lid 32 can be removed from the top piece 16 of the push-button dispenser by simply breaking the predetermined breaking points on the material bridges 35. It therefore offers a reliable first-opening guarantee and prevents any dirt or foreign objects from getting into the discharge channel 4 before the buyer removes this guarantee lid 32 for the first time. The top piece 16 forms on its one side the actual discharge channel 4 with mouth opening 5, i.e., a channel that leads from the inside of the dispenser to the outside. The top piece 16 is tapered on both sides. Thus, it can easily be grasped on top with two curved fingers, say, between index and middle finger. A bottle outfitted with this push-button dispenser can therefore be comfortably carried by two fingers.

FIG. 2 shows the entire dispenser including the suction tube 11 projecting down from the housing 14. The suction tube is a plastic tube, on which a mouthpiece 12 is set at the very bottom. This has an increased density, so that the suction tube 11 when the bottle is horizontal is curved downward due to the weight of the mouthpiece 12 and the mouthpiece 11 then comes to lie at the lowest point of the inside of the horizontal bottle, so that liquid is constantly sucked in to the end. This mouthpiece 12 has a density between 2.8 and 3.2 g/ml and is injection molded from a thermoplastic polybutylene terephthalate PBT, mixed and enriched with stone powder to increase its density. At the top, the suction tube 11 has a segment 10 that widens conically. This measure supports the suppression of foaming in the case of a carbonated beverage. The suction tube 11 and its conical segment 10 must have the smoothest possible inner surface, free of any grooves or steps, in order to avoid as much as possible any swirling of the moving liquid and, thus, its foaming.

FIG. 3 shows the dispenser with accommodating cylinder 8 opened. The threaded cap 6 is thus unscrewed and the outer thread of the accommodating cylinder 8 is visible. Between them is shown a pressure capsule 7. In most instances, this is a $CO_2$ pressure capsule with an internal pressure of up to 60 bar. But instead of $CO_2$, nitrogen can be used—thus, air in principle—if no carbonation is desired, but only a propellant that should act to drive out or dispense the liquid in the bottle.

FIG. 4 shows the dispenser 1 with compressed-gas capsule 7 in the assembled state in a sectional view along the axis of the suction tube 11 and the accommodating cylinder 8 for the threaded cap 7. One notices here the regulating means 39, which by its plumblike sealing cone 3 at the lower end passes through the accommodating sleeve 25 there at the end of the conically broadening suction tube segment 10. In this accommodating sleeve 25 there is placed an insert sleeve 36, injection-molded in the 2-component technique, which forms a sealing ring on the inside against which the shoulder of the sealing cone 3 abuts in sealing manner. The upper swordlike prolongation 13 of the regulating means 39 with boatlike cross section is held at its top end on the underside of the push-button 15 by a click or snap retainer. The compression spring 17 constantly presses the push-button 15 upward and thus also pulls the regulating means 39, suspended therefrom, upward, with the result that the sealing cone 3 is pressed by its shoulder tightly against the sealing ring in the insert sleeve 36. When the push-button 15 is operated, he presses the sealing cone 3 downward away from the sealing ring and liquid flows from the suction tube 11 around the sealing cone 3 and upward, then on either side along the swordlike prolongation 13 and further upward, and finally through the discharge channel 4 and out through its mouth 5.

The inner housing 37 forms a screw socket 40 at the bottom, with which the inner housing 37 can be screwed onto a bottle nozzle, such as a glass or PET bottle. For this, the screw socket 40 has on its inner side a corresponding thread, preferably a thread for the popular 28-mm nozzle of PET bottles. Of courses, other thread sizes are also possible. At the bottom of the screw socket 40 there can be seen an unscrewing lock 9 in the form of a ring with retaining ribs, which have a ratchet effect on the bottle nozzle, and this ring is formed by a thin spot. Once the dispenser has been screwed onto a bottle by the inner housing 37, it can only be unscrewed from the bottle once more by breaking this thin spot. Beneath this unscrewing lock 9 one notices the conical segment 10 of the suction tube 11.

At the right side of the drawing one sees the accommodating cylinder 8 to hold the compressed-gas capsule 7, formed by the inner housing 37. At the inner end of this accommodating cylinder 8, open at the bottom, there is installed a steel piercing tube 23 with beveled tip. The neck of the compressed-gas capsule 7 is encircled by an insert ring 22, so that it is centered on the piercing tube 23, and the insert ring 22 is adjoined by a sealing ring 21 for the compressed-gas capsule 7. The threaded cap 6 is screwed on from below and provided with radial grip fins 41, so that it can be screwed on by hand with sufficient torque. When a compressed-gas capsule 7 is inserted, this is first shoved into the accommodating cylinder 8, after which it is held there by friction with the insert ring 22. The threaded cap 6 is then mounted and screwed on, so that the compressed-gas capsule 7 is pressed across the piercing tube 23, which then pierces the lead-sealed closure at the mouth of the compressed-gas capsule 7 and penetrates into it, forming a seal. The compressed gas then escapes into the valve housing 27, as described more closely below.

FIG. 5 shows further individual parts of the dispenser, namely, the housing 14 and its interior parts, namely, the regulating means 39 with its plumblike sealing cone 3, although only its lower tip is visible here, and at the top its swordlike prolongation 13. This regulating means 39 lies in an accommodating sleeve 25 with insert ring 36 and sealing ring placed therein, not being visible here. For the assembly process, at first it is placed from above through the accommodating sleeve 25 and then the insert ring 36 is inserted from above. After this, the regulating means 39 can no longer be pulled out from the accommodating sleeve 25 at the top, because the shoulder of its sealing cone 3 is against the sealing ring. Beneath the tip of the sealing cone 3 one notices an installation ring 24, and beneath this an unscrewing lock 9. Once the dispenser has been screwed onto a bottle, it cannot so easily be removed from it once more.

Behind the swordlike prolongation 13 on the regulating means 39 one can see the valve housing 27 for the pressure control inside the bottle, as well as one of the two installation screws 26 for the housing 14. Alongside it, one notices the compression spring 17 for the push-button 15, which is operated against the force of this compression spring 17. The upper end of the swordlike prolongation 13 of the regulating means 39 is secured at the underside of the push-button 15 by a click or snap closure, so that the push-button 15 constantly pulls the regulating means 39 upwards and thus presses the top, or shoulder of the sealing cone 3, against the sealing ring in the accommodating sleeve 25. The top piece 16 with its discharge channel 4, here projecting to the rear, receives the push-button 15 at the top, having two downward projecting guide pins 18 for this.

At the right side of the drawing one sees the inner housing 37, which can be placed in the housing 14 from the bottom. On this is molded the accommodating cylinder 8 for the compressed-gas capsule 7. At the top, two pins 38 with blind holes are molded, serving to accommodate the installation screws 26. After the regulating means and the valve housing 27 have been installed in the inner housing 37, the housing 14 is pulled over the inner housing 37 and screwed together with it. After this, the top piece 16 with its discharge channel 4 and the push-button accommodated therein is placed from above on the housing 14, the push-button 15 clicking together by friction with the upper end of the swordlike prolongation 13 of the regulating means 39.

Inside the accommodating cylinder 8 are the piercing tube 23 with its obliquely beveled tip, as well as an insert ring 22 for the centering and securing of the neck of the compressed-gas capsule, and furthermore a sealing ring 21 for sealing the compressed-gas capsule 7 from the outside. The compressed-gas capsule 7 itself cannot present any danger potential, since it cannot be willingly removed from the accommodating cylinder 8 in the still full or partially full state. This is because the threaded cap is configured long enough that when the threaded cap 6 is unscrewed it has to cover so long a distance that the gas first flows out from the compressed-gas capsule 7 and escapes through a relief borehole in the accommodating cylinder 8 and the threaded cap 6 before the compressed-gas capsule 7 proper can be removed from the accommodating cylinder.

FIG. 6 shows the push-button dispenser in another view with all its individual parts. One notices here also the individual parts of the valve housing 27. Inside this valve housing 27 there is a valve 29 with a valve ball inside it. The ball is pressed by a spring against a valve seal. The pressure regulating spring 20 is accommodated axially in the valve housing 27 and represents the nominal pressure in the bottle. Once the pressure drops below this nominal value, the pressure from the compressed-gas capsule 7 is able to press the ball out from the valve seal and gas flows around the ball into the valve housing 27 and from there further into the inner housing 37 and down into the inside of the bottle. The guide ring 30 for the pressure regulating spring 20 and the seal 31 of the valve ball are drawn as structural parts. At the rear of the valve housing 27, the latter is closed by a cover disk 19 with central borehole. To the right of these parts one notices the piercing tube 23, the insert ring 22 and the sealing ring 21 for the neck of the compressed-gas capsule 7, as well as the compressed-gas capsule 7 itself and the threaded cap 6 with its inner thread.

Inside the inner housing, an excess pressure safety is installed as an important mechanism. This is shown in FIG. 7. The compressed gas from the compressed-gas capsule 7 flows out from the valve housing 27 through a channel 43 in the inner housing 37 into the inside of the bottle. At the side of this channel 43, an excess pressure safety cap 45 is formed in the channel wall, with a diameter of around 2.5 mm, which is held in place only by a thin spot 44 all around. This thin spot is only around 0.1 mm thick. Once the pressure inside the bottle exceeds a value of 4 bar, this excess pressure safety cap 45 is blown away in the direction of the arrow shown, rupturing the encircling thin spot 44. The gas escapes at once through this opening to the outside, through a relief borehole in the inner housing 37. That the dispenser is then unusable is entirely intentional, for the fact that the inner pressure in the bottle has risen above 4 bar indicates that something is wrong with the pressure regulation of this dispenser. If it were still usable, it might represent a danger potential for future users. By its deliberate self-destruction when a pressure value of, say, 4 bar is exceeded, any danger potential can be excluded.

List of Reference Numbers

1 push-button dispenser
2 bottle
3 plumblike sealing cone regulating means
4 discharge channel
5 mouth opening of discharge channel
6 threaded cap
7 compressed-gas capsule
8 accommodating cylinder for compressed-gas capsule
9 unscrewing lock
10 suction tube segment widening conically
11 suction tube
12 mouthpiece
13 swordlike prolongation of the regulating means
14 housing
15 push-button
16 top piece with discharge channel
17 compression spring for push-button
18 guide pins for push-button
19 valve cover disk
20 pressure regulating spring
21 sealing ring for neck of compressed-gas capsule
22 insert ring for neck of compressed-gas capsule
23 piercing tube
24 installation ring for suction tube
25 accommodating sleeve for sealing cone of the regulating means
26 installation screw for housing
27 valve housing
28
29 valve with valve ball inside
30 guide ring for pressure regulating spring
31 seal for valve ball
32 guarantee lid
33 sealing ring on guarantee lid
34 guarantee tab
35 material bridges on guarantee tab
36 insert sleeve
37 inner housing
38 pins with blind holes
39 regulating means
40 screw socket
41 grip fins on threaded cap
42 angled cover on guarantee lid
43 channel from valve housing
44 thin spot for excess pressure safety
45 excess pressure safety cap
46 encircling band of guarantee lid

The invention claimed is:

1. A push-button dispenser for a bottle, comprising:

a head adapted to be screwed onto the bottle, the head comprising:

a lateral discharge channel;

a push-button on an upper side of the head; and a downwardly projecting suction tube, which extends as far as a bottom of the bottle, wherein a top end of the suction tube opens out into a valve device in the head, and wherein the valve device comprises:

a regulating means configured to move axially in relation to the bottle, wherein the regulating means is biased in a closing direction by a spring, wherein the regulating means is configured to be opened by manual pressure being applied to the push-button, such that upon opening, a pressure in an interior of the suction tube reduces to an ambient pressure, as a result of which liquid is expelled from the bottle, by way of an internal pressure prevailing in the bottle, and wherein the liquid is expelled out of an opening at the top end of the suction tube via the lateral discharge channel, and wherein the regulating means comprises a plumb-like sealing cone with a sword-like prolongation on top, wherein the plumb-like sealing cone rests against a sealing ring, and the sword-like prolongation is pulled upward at its upper end from the push-button by virtue of a compression spring; and a single-piece housing, wherein a side of the single-piece housing comprises:

an open accommodating cylinder with a steel piercing tube installed concentrically therein and directed outwards for the purpose of accommodating a compressed-gas capsule, wherein the compressed-gas capsule can be pushed into the open accommodating cylinder until it reaches the tip of the steel piercing tube and is retained in this position by static friction, and wherein the compressed-gas capsule can be pushed further axially in the open accommodating cylinder by screwing on an associated threaded cap, so that the steel piercing tube, which is cut obliquely in front, pierces a lead-sealed piercing closure with a sealing action.

2. The push-button dispenser of claim 1, wherein the open accommodating cylinder for the compressed-gas capsule is oriented downward on an inner housing subtending a maximum angle of 35° to a screw-on axis.

3. The push-button dispenser of claim 1, further comprises:

four separate one-piece parts visible from the outside, the four separate one-piece parts comprising:

the single-piece housing;

a top piece arranged thereon with the lateral discharge channel;

the push-button arranged in the top piece; and the threaded cap associated with the single-piece housing for the open accommodating cylinder of the compressed-gas capsule situated inside it.

4. The push-button dispenser of claim 1, wherein a top piece with the push-button and the lateral discharge channel is configured such that the push-button is situated and mounted obliquely to the screw-on axis of the push-button dispenser, yet it can be pressed in the direction of the screw-on axis of the push-button dispenser, and wherein an upper boundary surface of the top piece and the push-button is aligned laterally at its lowest point tangentially in a top portion of the lateral discharge channel, which then curves downward and defines a plane by its mouth opening that subtends an angle of around 35° with the screw-on axis.

5. The push-button dispenser of claim 1, wherein a valve housing with a valve is installed in the single-piece housing for pressure control in the bottle, the valve housing comprising:

a valve ball with a pressure regulating spring, wherein the valve prevents an arrival of compressed gas from the compressed-gas capsule when the valve ball is loaded by the pressure regulating spring, and wherein the pressure regulating spring represents nominal pressure in the bottle, such that when pressure drops below a value of the nominal pressure, the pressure regulating spring relieves the valve ball, such that a delivery of compressed gas from the compressed-gas capsule is opened up.

6. The push-button dispenser of claim 1, wherein an excess pressure safety cap with an encircling predetermined breaking site of 0.1 mm thickness is arranged inside a valve housing, which breaks when the internal pressure in the bottle is more than 4 bar, such that gas escapes from a relief borehole in an inner housing and the push-button dispenser is intentionally made unusable thereafter.

7. The push-button dispenser of claim 1, wherein the top end of the suction tube is placed tightly in a clamping fixture, in which a flow channel of the suction tube is fitted and then passes into a conically widening segment, wherein the flow channel forms an accommodating sleeve at the top, in which an insert sleeve injection molded by the 2-component technique is placed, with the sealing ring injected molded on the inside, through which the regulating means extends, and wherein when manual pressure is applied from above to the push-button the regulating means with the plumb-like sealing cone can be moved downward from the sealing ring so that the liquid expelled by the suction tube flows all around the plumb-like sealing cone and then along the sword-like prolongation and across the discharge channel to the outside.

8. The push-button dispenser of claim 1, wherein a top piece has a socket that is tapered at the side so that it can be grasped from above between an index finger and a middle finger of one hand and thereby the bottle outfitted with the push-button dispenser can be carried by two fingers.

9. The push-button dispenser of claim 1, further comprises:

a guarantee lid that can be clicked onto a top piece from above, wherein the guarantee lid forms a cover cap for the mouth of the lateral discharge channel, and at its opposite side the guarantee lid has a guarantee tab projecting downward across material bridges with predetermined breaking sites, which can be forced onto the top piece during assembly of the guarantee lid and can be removed by breaking its predetermined breaking sites associated with the guarantee lid.

10. The push-button dispenser of claim 1, further comprising:

a mouthpiece with a density between 2.8 and 3.2 g/ml placed on a mouth opening at a bottom end of the suction tube, such that when a bottle outfitted with the push-button dispenser is lying on its side the mouth opening of the suction tube comes to lie at the lowest point of the interior of the bottle by the weight of the mouthpiece.

11. The push-button dispenser of claim 10, wherein the mouthpiece comprises a thermoplastic polybutylene terephthalate PBT combined with powdered rock.

* * * * *